US008869690B2

(12) United States Patent
Wang

(10) Patent No.: US 8,869,690 B2
(45) Date of Patent: Oct. 28, 2014

(54) STATIONERY MACHINE

(76) Inventor: Ming-Cheng Wang, Taichung (TW)

( * ) Notice: Subject to any disclaimer, the term of this patent is extended or adjusted under 35 U.S.C. 154(b) by 312 days.

(21) Appl. No.: 13/606,596

(22) Filed: Sep. 7, 2012

(65) Prior Publication Data

US 2014/0069248 A1 Mar. 13, 2014

(51) Int. Cl.
*B30B 3/04* (2006.01)

(52) U.S. Cl.
USPC ..... 100/176; 100/168; 100/169; 100/171; 100/172; 100/159; 83/629

(58) Field of Classification Search
USPC ..... 83/331, 344–347, 431, 495, 507, 508.1, 83/508.2, 561, 571, 673, 675, 304, 305, 83/287, 288, 296, 298, 299, 629; 226/181, 226/182–187, 191; 100/176, 168, 169, 171, 100/172, 159, 161, 163, 164; 425/367, 363, 425/182, 194
See application file for complete search history.

(56) References Cited

U.S. PATENT DOCUMENTS

| | | | | |
|---|---|---|---|---|
| 2,837,978 | A * | 6/1958 | Anderson | 493/365 |
| 5,083,488 | A * | 1/1992 | Stanley et al. | 83/344 |
| 6,205,898 | B1 * | 3/2001 | Surina | 83/76 |
| 7,293,501 | B2 * | 11/2007 | Lee | 100/176 |
| 7,360,482 | B2 * | 4/2008 | Deng et al. | 100/176 |
| 2007/0214972 | A1 * | 9/2007 | Ayala et al. | 100/176 |
| 2011/0185923 | A1 * | 8/2011 | Lee | 100/176 |
| 2011/0252939 | A1 * | 10/2011 | Nabity et al. | 83/859 |

* cited by examiner

*Primary Examiner* — Boyer D Ashley
*Assistant Examiner* — Richard Crosby, Jr.

(57) ABSTRACT

A stationery machine is used to cut various patterns on a paper and contains a housing for covering a machine body; the machine body including a frame with a first side plate and a second side plate, the first side plate and the second side plate having a first elongated slot and a second elongated slot on two lower sides thereof; a first pressing roller having a first rotary shaft driven by a crank set and at least two transmission gears in different sizes; a second pressing roller having a second rotary shaft, the second rotary shaft of the second pressing roller having a driven gear; an abutting mechanism biasing the second pressing roller to move upwardly and downwardly so as to adjust a distance between the second pressing roller and the first pressing roller, and the driven gear meshing with the at least two transmission gears.

10 Claims, 11 Drawing Sheets

STATIONERY MACHINE

FIELD OF THE INVENTION

The present invention relates to a stationery machine which allows adjusting a distance between a first pressing roller and a second pressing roller so as to cooperate with a first cutter template and a second cutter template in different thicknesses and to roll the first cutter template and the second cutter template by ways of the first pressing roller and the second pressing roller, thus cutting various patterns on a paper and adjusting a rolling thickness.

BACKGROUND OF THE INVENTION

Referring to FIG. 1, a conventional stationery machine 10 is used to cut various patterns on a paper in a rolling manner so that children may play different patterns of papers by matching with cutter templates with different patterns. The conventional stationery machine 10 contains a frame 11 having two side plates 111, a crank 12 axially connected on one of the two side plates 111 for driving a first pressing roller 14, a transmission gear 13 disposed on a first end of the first pressing roller 13, a second pressing roller 15 fixed between the two side plates 111 under the first pressing roller 14, and a driven gear 16 fixed on a first end of the second pressing roller 15 for meshing with the first pressing roller 14. In addition, between the first pressing roller 13 and the second pressing roller 15 is defined a distance to input the cutter templates, such that the first pressing roller 13 and the second pressing roller 15 allow cutting different patterns on the paper in the rolling manner.

With reference to FIG. 2, the cutter templates have two different thicknesses. For example, each of a plurality of first cutter templates 20A has a large flat surface and thickness, a first cutting pattern area 201A, and a first foam layer 202A higher than the first cutting pattern area 201A formed around the first cutting pattern area 201A, such that when a first paper 21A is placed over the first form layer 202A, a first upper clamping sheet 22A and a first lower clamping 23A are used to press the plurality of first cutter templates 20A and the first paper 21A, thereafter the plurality of first cutter templates 20A and the first paper 21A are placed into the stationery machine 10 so as to cut the patterns on the first paper 21A. Besides, each of a plurality of second cutter templates 20B has a small flat surface and thickness, a second cutting pattern area 201B, and a second foam layer 202B higher than the second cutting pattern area 201B formed around the second cutting pattern area 201B, such that when a second paper 21B is placed over the second form layer 202B, a second upper clamping sheet 22B and a second lower clamping sheet 23B are used to press the plurality of second cutter templates 20B and the second paper 21B, thereafter the plurality of second cutter templates 20B and the second paper 21B are placed into the stationery machine 10 so as to cut patterns on the second paper 21B.

As shown in FIGS. 2 and 3, because between the first pressing roller 13 and the second pressing roller 15 is defined the distance, when the first cutter templates 20A is applied to cut the patterns, the first upper clamping sheet 22A and the first lower clamping sheet 23A are served to match with the distance between the first pressing roller 13 and the second pressing roller 15. As the second cutter templates 20B is applied to cut the patterns, the second upper clamping sheet 22B and the second lower clamping sheet 23B are served to match with the distance between the first pressing roller 13 and the second pressing roller 15.

Therefore, the first cutter templates 20A and the second cutter templates 20B in different thicknesses have to cooperate with the first upper clamping sheet 22A, the second upper clamping sheet 22B, the first lower clamping sheet 23A, and the second lower clamping 23B, thus causing an using inconvenience.

The present invention has arisen to mitigate and/or obviate the afore-described disadvantages.

SUMMARY OF THE INVENTION

The primary object of the present invention is to provide a stationery machine which allows adjusting a distance between a first pressing roller and a second pressing roller so as to cooperate with a first cutter template and a second cutter template in different thicknesses and to roll the first cutter template and the second cutter template by ways of the first pressing roller and the second pressing roller, thus cutting various patterns on a paper and adjusting a rolling thickness.

Another object of the present invention is to provide a stationery machine in which the first cutter template and the second cutter template are applicable for the upper clamp sheet and the same lower clamp sheet in the same size.

To obtain the above objective, a stationery machine provided by the present invention contains:

a housing for covering a machine body;

the machine body including a frame, the frame having a first side plate and a second side plate fixed on two sides thereof, and the first side plate and the second side plate having a first elongated slot and a second elongated slot defined on two lower sides thereof;

a first pressing roller having a first rotary shaft driven by a crank set and fixed between the first side plate and the second side plate, the first pressing roller also having at least two transmission gears in different sizes disposed on a first end of the first rotary shaft;

a second pressing roller having a second rotary shaft inserted in the first elongated slot of the first side plate and the second elongated slot of the second side plate, the second rotary shaft of the second pressing roller having a driven gear disposed on a first end thereof for moving axially;

an abutting mechanism biasing the second pressing roller to move upwardly and downwardly so as to adjust a distance between the second pressing roller and the first pressing roller, and the driven gear of the second pressing roller meshing with the at least two transmission gears of the first pressing roller.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
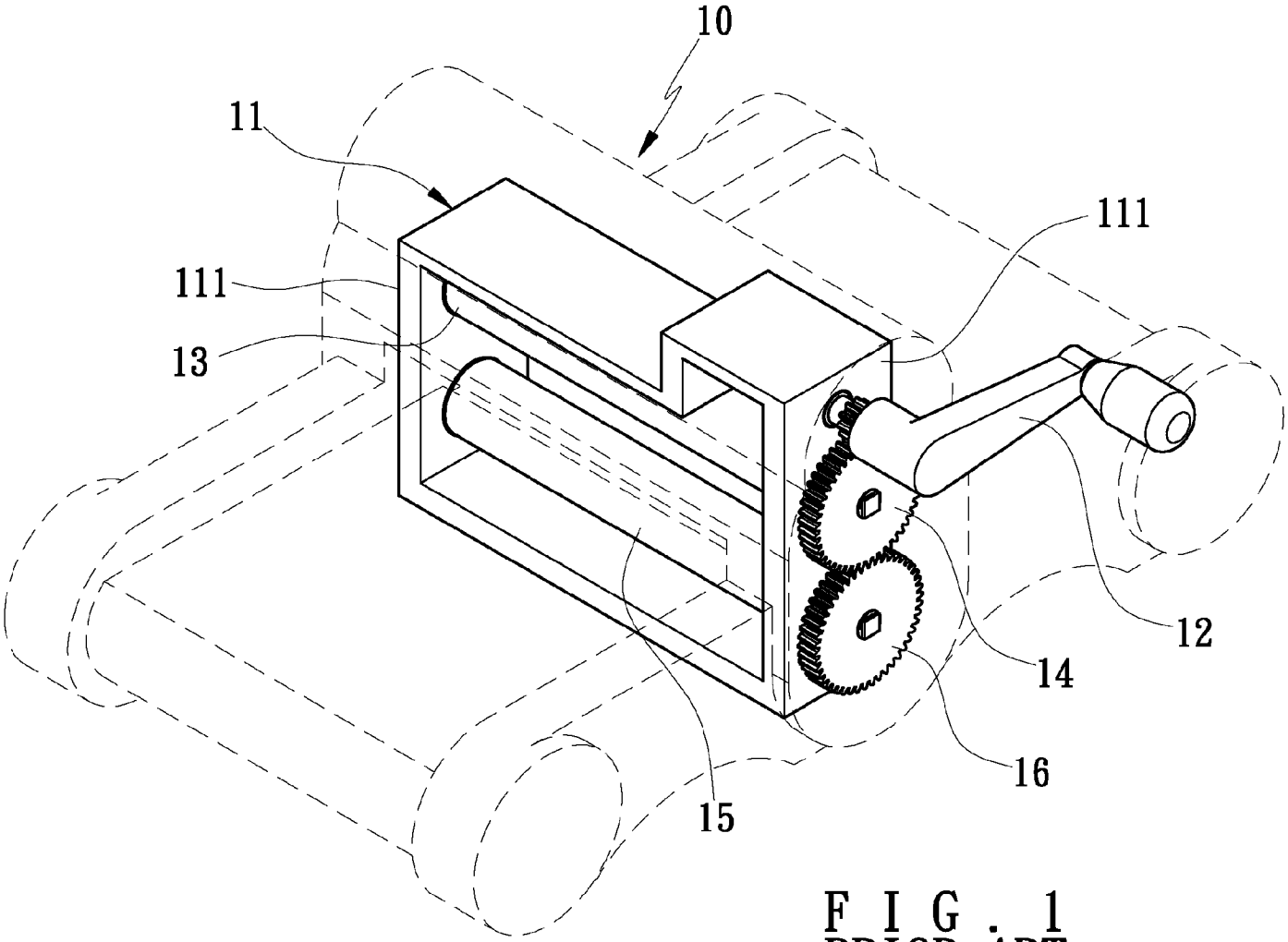
FIG. 1 PRIOR ART
FIG. 1 is a perspective view of a conventional stationery machine.
Figure 2:
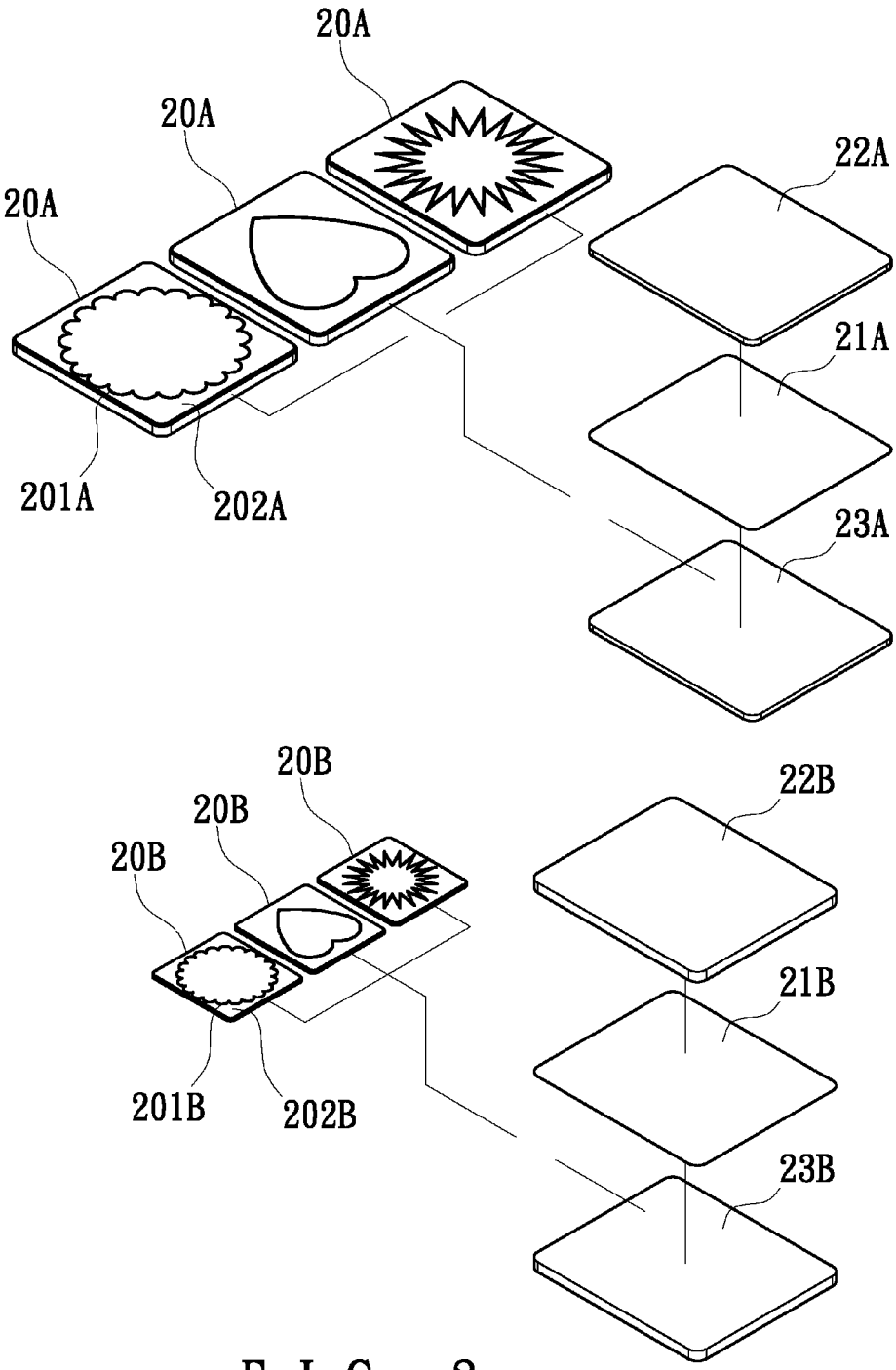
F I G . 2 PRIOR ART
FIG. 2 is a perspective view showing the exploded components of the conventional cutter template.
Figure 3:
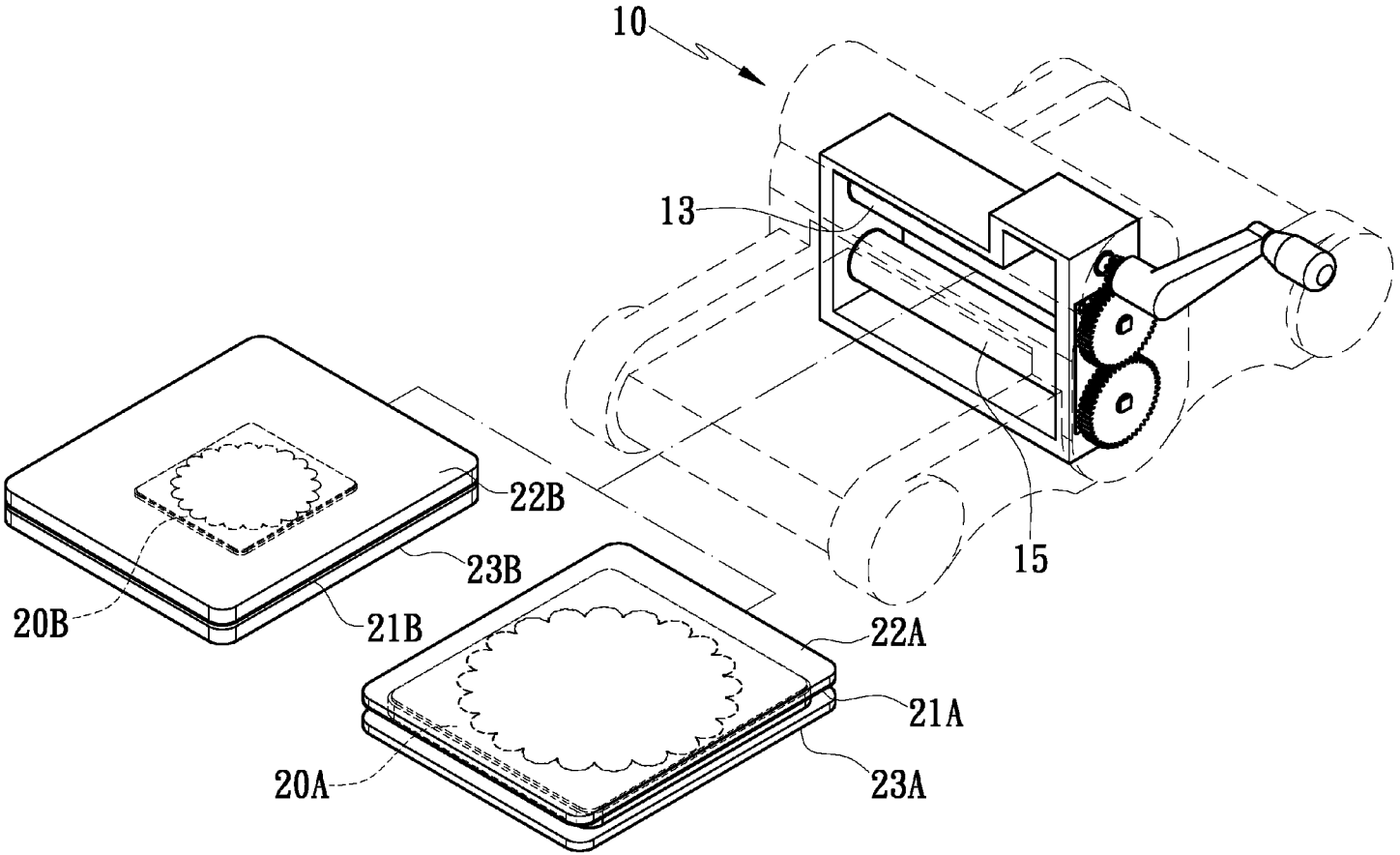
FIG. 3 PRIOR ART
FIG. 3 is a perspective view showing the operation of the conventional cutter template.
Figure 4:
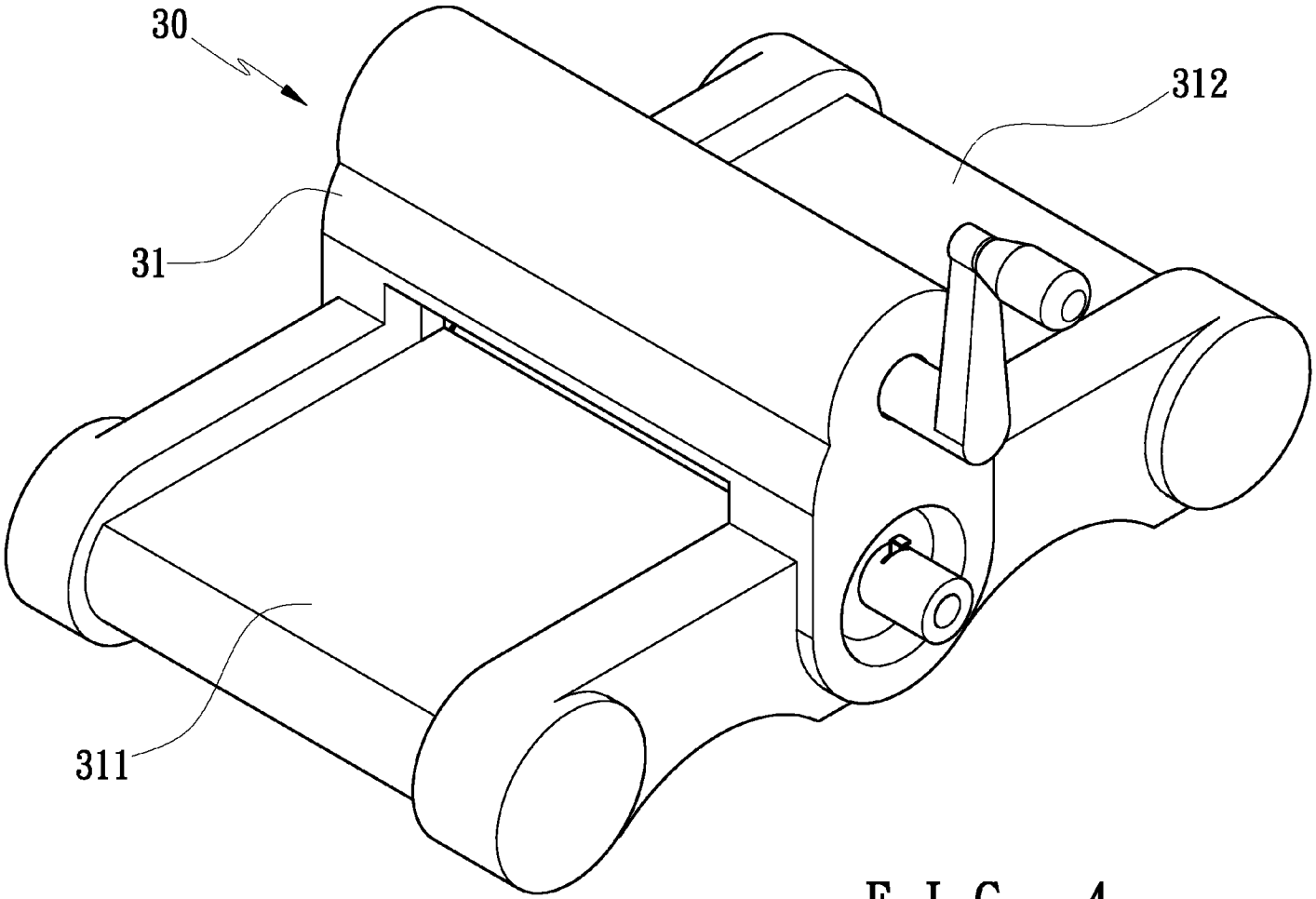
FIG. 4 is a perspective view showing the assembly of a stationery machine according to a first embodiment of the present invention.
Figure 5:
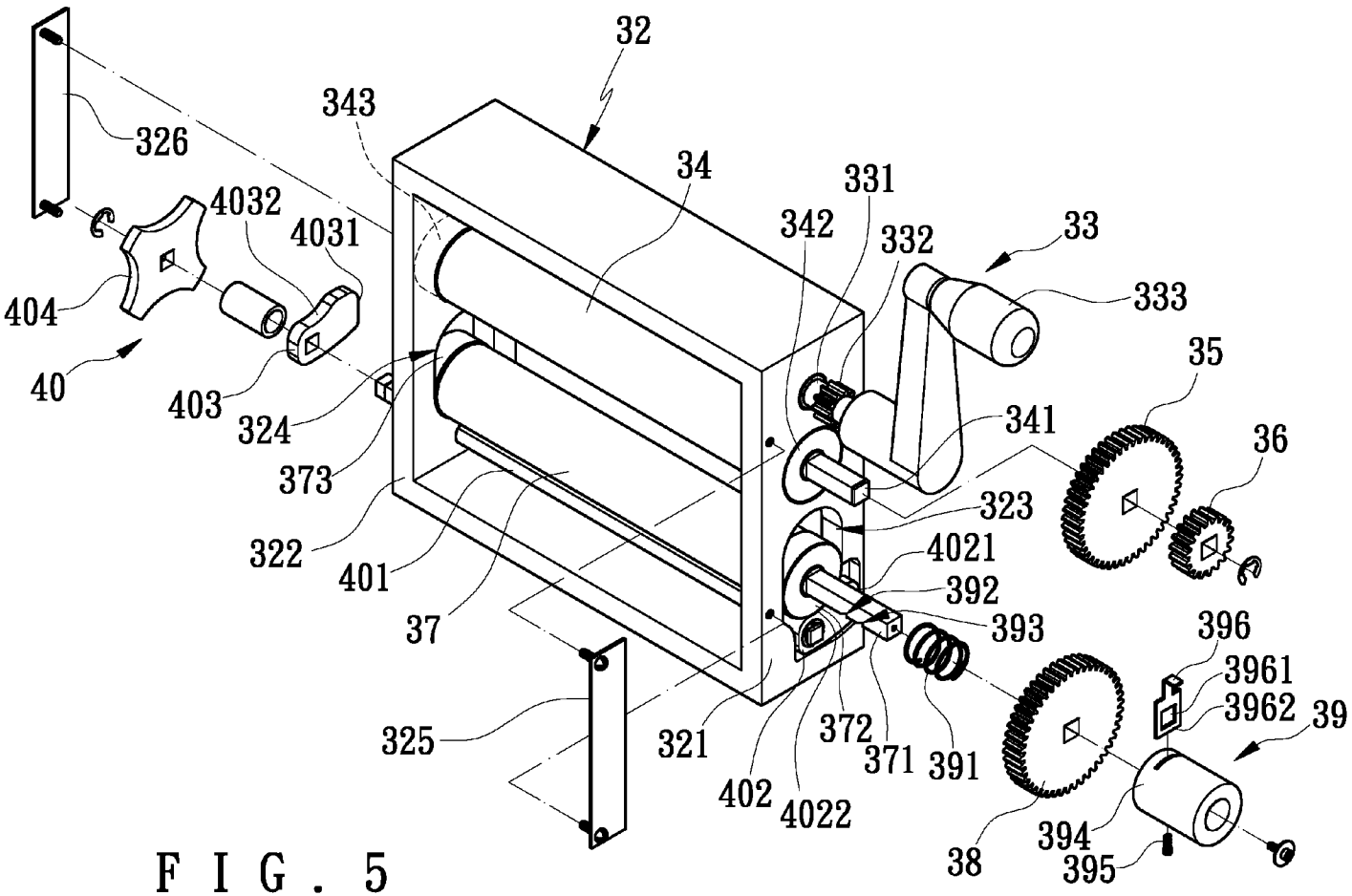
FIG. 5 is a perspective view showing the exploded components of the stationery machine according to the first embodiment of the present invention.
Figure 6:
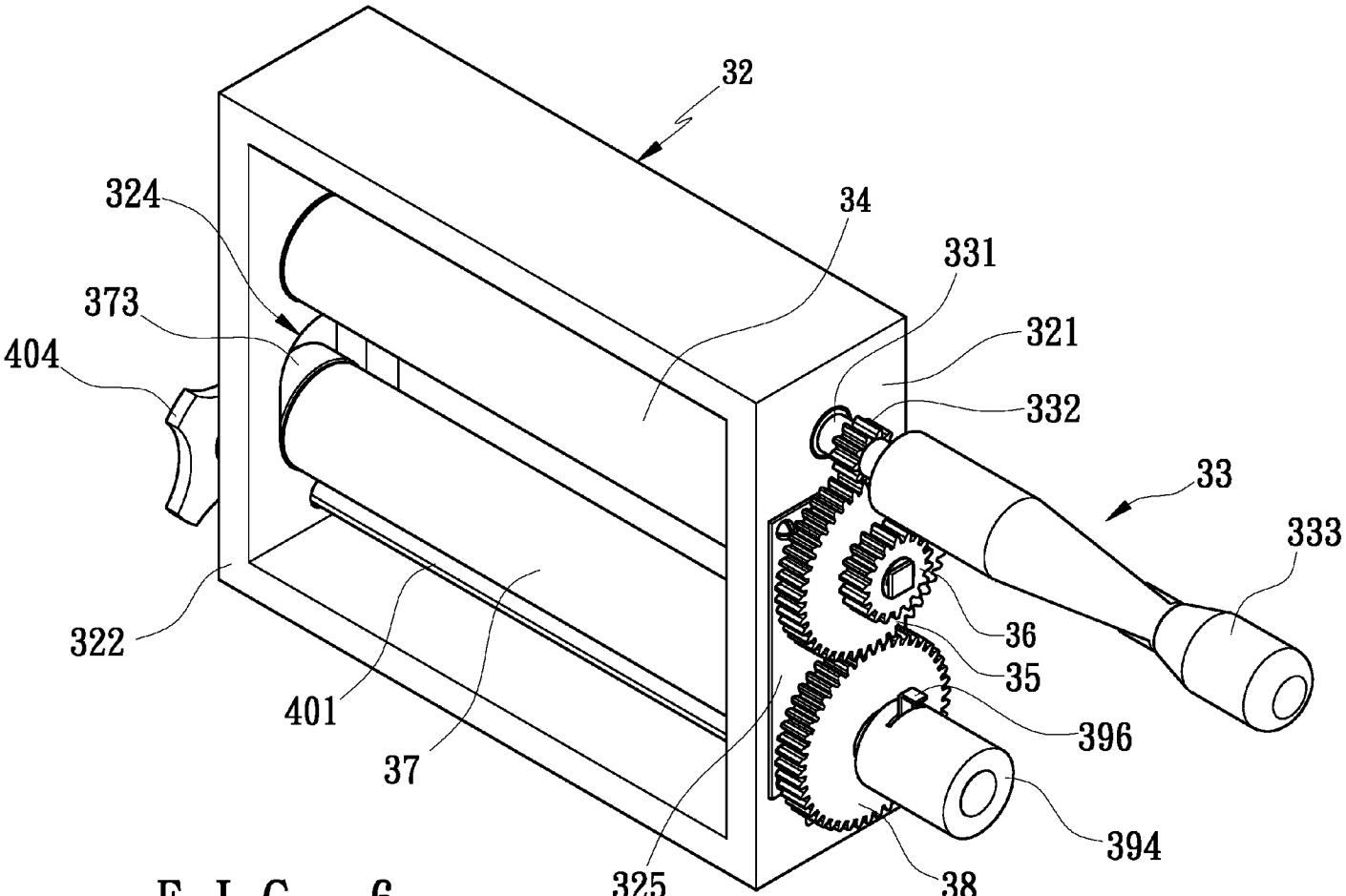
FIG. 6 is a perspective view showing the assembly of the stationery machine according to the first embodiment of the present invention.
Figure 7:
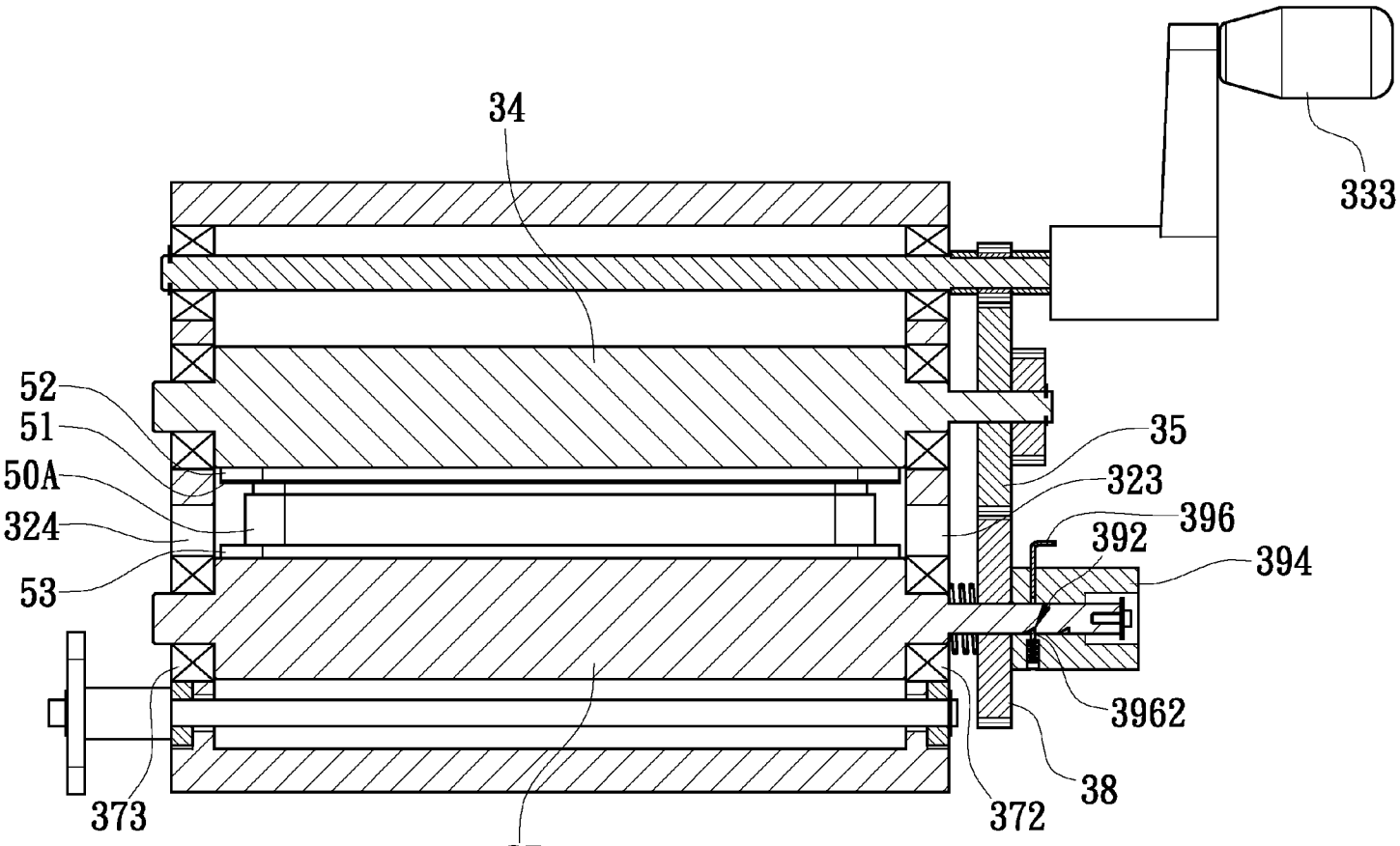
FIG. 7 is a cross sectional view showing the operation of the stationery machine according to the first embodiment of the present invention.

With reference to FIG. 4, a stationery machine 30 according to a first embodiment of the present invention is used to cut various patterns on a paper and comprises: a housing 31 plastic molded and used to cover a machine body, the housing 31 including a feeding platform 311 defined on a front end thereof to input an original cutter template and a holding platform 312 defined on a rear end thereof to collect a cutter template molded in a rolling and cutting process. Referring further to FIGS. 5-7, the machine body includes a frame 32 having a first side plate 321 and a second side plate 322 between which a first pressing roller 34 is fixed, and a crank set 33 disposed on the first side plate 321 to drive the first pressing roller 34. In this embodiment, the first pressing roller 34 has a first rotary shaft 341, two ends of which have two first bearing sets 342, 343, wherein the two first bearing sets 342, 343 are connected with the first side plate 321 and the second side plate 322, and the first pressing roller 34 has at least two transmission gears in different sizes secured on a first end of the first rotary shaft 341. In this embodiment, a first transmission gear 35 with a large diameter and a second transmission gear 36 with a small diameter are disposed on the first end of the first rotary shaft 341. To drive the first pressing roller 34, in this embodiment, the crank set 33 has an input stem 331 axially connected thereon, a driving gear 332 fixed on a first end of the input stem 331 for meshing with the first transmission gear 35, and a rotatable handle 333 mounted on a second end of the input stem 331 so that as rotating the rotatable handle 333, the driving gear 332 is driven to actuate the first transmission gear 35, and then the first transmission gear 35 drives the first pressing roller 34 to rotate. The first side plate 321 and the second side plate 322 have a first elongated slot 323 and a second elongated slot 324 defined on two lower sides thereof below the first pressing roller 34 so as to insert a second pressing roller 37. In this embodiment, the second pressing roller 37 has a second rotary shaft 371, two ends of which have two second bearing sets 372, 373, wherein the two second bearing sets 372, 373 are placed in the first elongated slot 323 of the first side plate 321 and the second elongated slot 324 of the second side plate 322. To avoid the first pressing roller 34 and the second pressing roller 37 from moving horizontally, in this embodiment, the first side plate 321 has a first stopping piece 325 mounted on an outer surface thereof, and the second side plate 322 has a second stopping piece 326 mounted on an outer surface thereof. The second rotary shaft 371 of the second pressing roller 37 has a driven gear 38 disposed on a first end thereof for moving axially and an adjusting mechanism 39 secured on the first end thereof for adjusting the driven gear 38 to correspond to the first transmission gear 35 and the second transmission gear 36 in different sizes. In this embodiment, the adjusting mechanism 39 has a first spring 391 fitted on the second rotary shaft 371, a first recess 392 and a second recess 393 defined at a predetermined position of the second rotary shaft 371, a sleeve 394 fitted onto the second rotary shaft 371, wherein the sleeve 394 has a retainer 396 mounted therein and abutted by a second spring 395, the retainer 396 has a through hole 3961, a diameter of which is larger than the second rotary shaft 371, and the retainer 396 also has a stop rim 3962 defined under the through hole 3961 so that when the sleeve 394 is pushed, the driven gear 38 is driven to axially move along the second rotary shaft 371 so as to correspond to the first transmission gear 35 or the second transmission gear 36 in different sizes. When the driven gear 38 corresponds to the first transmission gear 35, the retainer 396 is abutted by the second spring 395 so that its stop rim 3962 retains in the first recess 392, thus positioning the driven gear 38. Or when the driven gear 38 corresponds to the second transmission gear 36, the retainer 396 is abutted by the second spring 395 so that the stop rim 3962 retains in the second recess 393, thus positioning the driven gear 38. And when desiring to release the positioning of the driven gear 38, the retainer 396 is pressed so that the stop rim 3962 of the retainer 396 disengages from the first recess 392 or the second recess 393, such that the driven gear 38 allows being moved adjustably. To adjust a distance between the first pressing roller 34 and the second pressing roller 37 and to mesh the driven gear 38 with the first transmission gear 35 or the second transmission gear 36, an abutting mechanism 40 is provided under the second pressing roller 37 so that the second pressing roller 37 is biased by the abutting mechanism 40 to move upwardly and downwardly. The abutting mechanism 40 includes a rotating rod 401 axially connected with the first side plate 321 and the second side plate 322, a first biasing slice 402 and a second biasing slice 403 fixed on two ends of the rotating rod 401, and a profile of the first biasing slice 402 is the same as that of the second biasing slice 403, the first biasing slice 402 has a first top rim 4021 and a first cam face 4022, the second biasing slice 403 has a second top rim 4031 and a second cam face 4032. The abutting mechanism 40 also includes an actuating slice 404 fitted on one of the two ends of the rotating rod 401 adjacent to the second side plate 322 so that after the actuating slice 404 is rotated, the rotating rod 401 is driven by the actuating slice 404 to further drive the first biasing slice 402 and the second biasing slice 403 to rotate, and then the first cam face 4022 of the first biasing slice 402 and the second cam face 4032 of the second biasing slice 403 push the two second bearing sets 372, 373 of the second rotary shaft 371 so that the two second bearing sets 372, 373 are retained by the first top rim 4021 and the second top rim 4031, such that the second pressing roller 37 is moved upwardly to adjust the distance between the first pressing roller 34 and the second pressing roller 37, and the driven gear 38 meshes with the second transmission gear 36.

Figure 8:
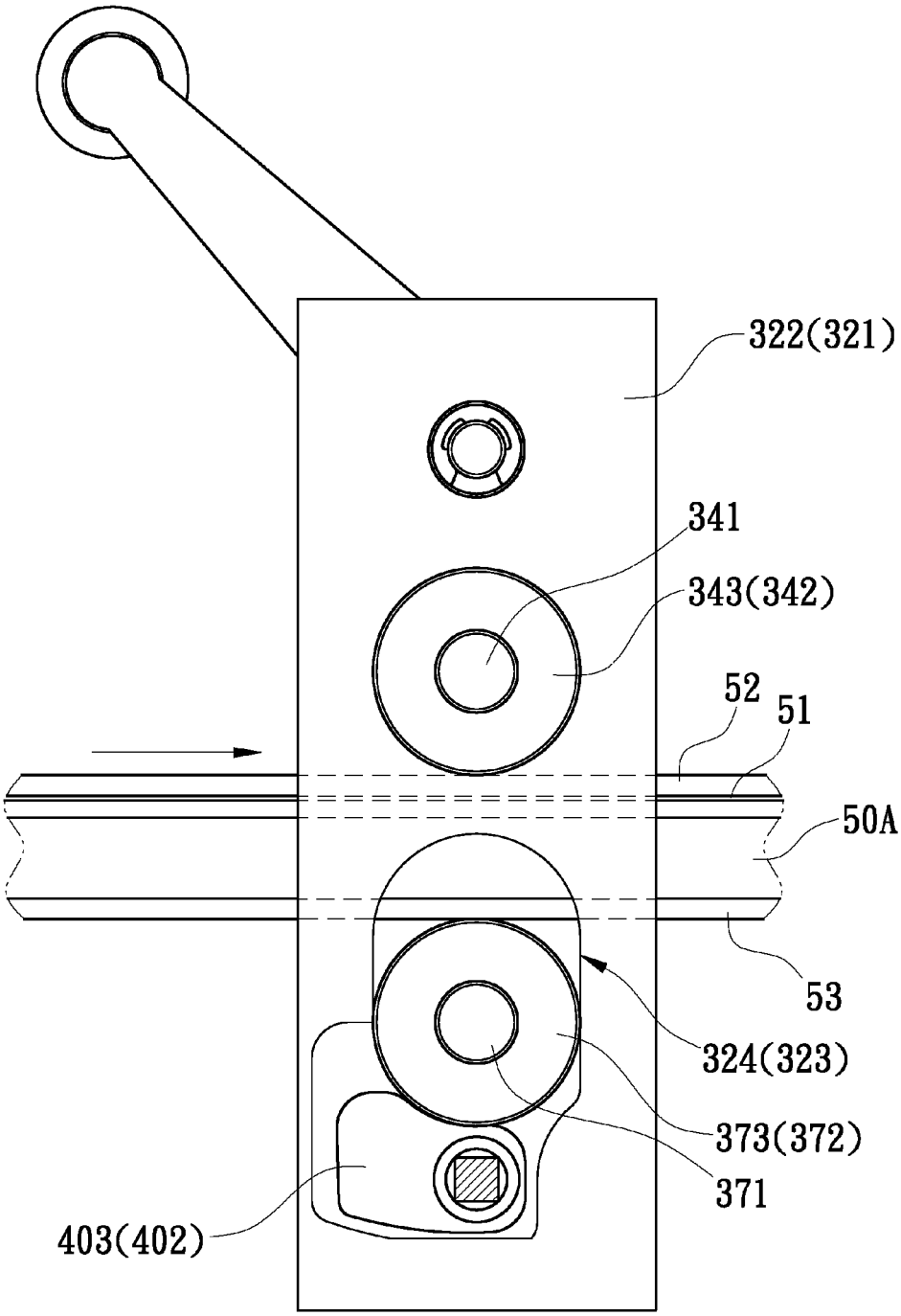
FIG. 8 is another cross sectional view showing the operation of the stationery machine according to the first embodiment of the present invention.

As shown in FIGS. 7 and 8, when the machine body of the stationery machine is used to cut a first cutter template 50A with a large flat surface and thickness, a paper 51 is placed on the first cutter template 50A, and an upper clamp sheet 52 and a lower clamp sheet 53 are applied to press the first cutter template 50A and the paper 51, thereafter the first cutter template 50A and the paper 51 are inputted between the first pressing roller 34 and the second pressing roller 37. To match with the first cutter template 50A, the sleeve 394 is pushed to drive the driven gear 38 to slide axially and correspond to the first transmission gear 35, and the stop rim 3962 of the retainer the retainer 396 retains in the first recess 392, thus positioning the driven gear 38. Due to the two second bearing sets 372, 373 of the second pressing roller 37 are placed at two lowest positions of the first elongated slot 323 and the second elongated slot 324 where the driven gear 38 meshes with the first transmission gear 35, and a first distance between the first pressing roller 34 and the second pressing roller 37 is a rolling thickness for inputting the first cutter template 50A, thereafter the rotatable handle 333 is rotated so that the first transmission gear 35 drives the driven gear 38, and the first pressing roller 34 and the second pressing roller 37 roll the first cutter template 50A so as to cut patterns on the paper.

Figure 9:
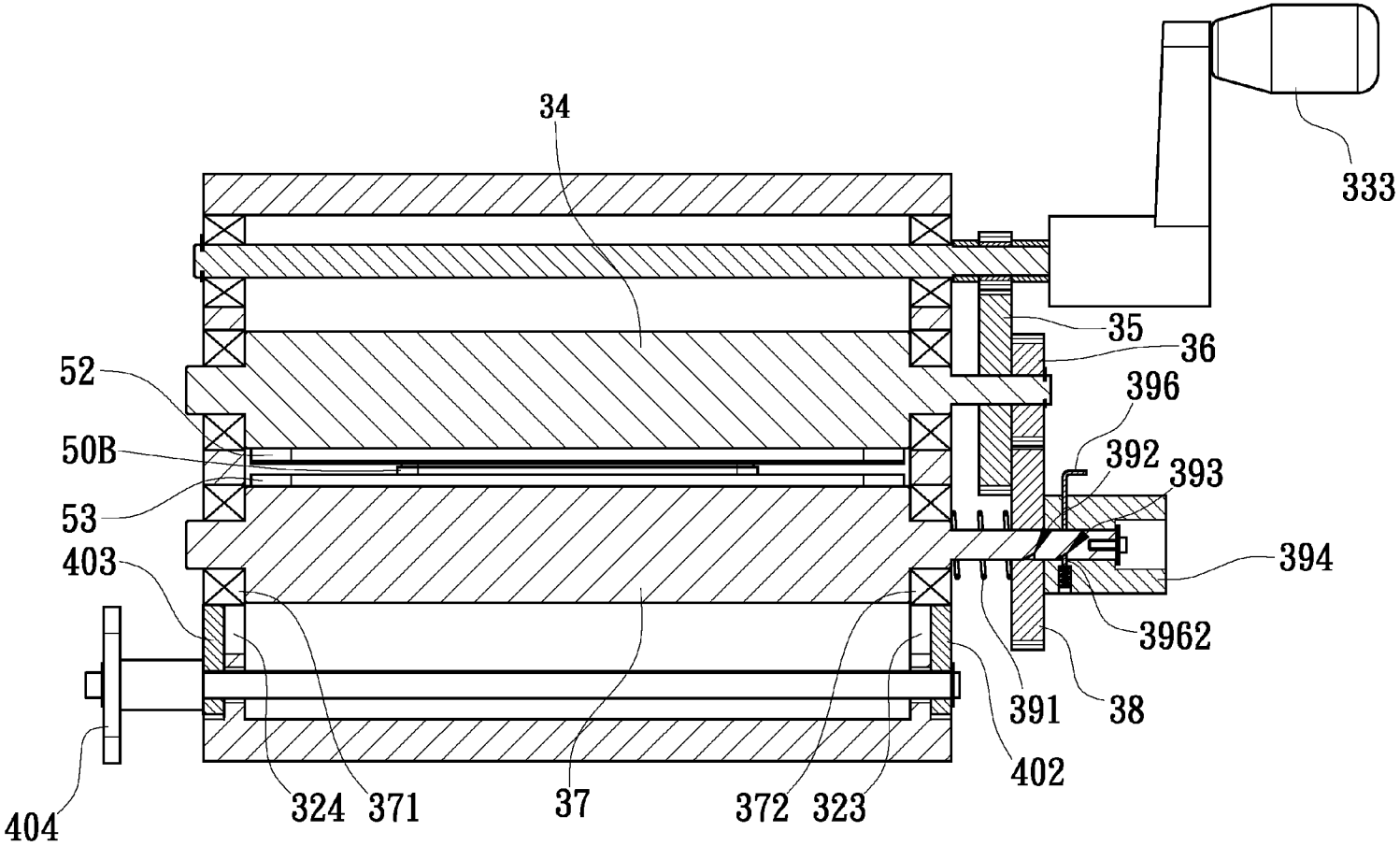
FIG. 9 is also another cross sectional view showing the operation of the stationery machine according to the first embodiment of the present invention.
Figure 10:
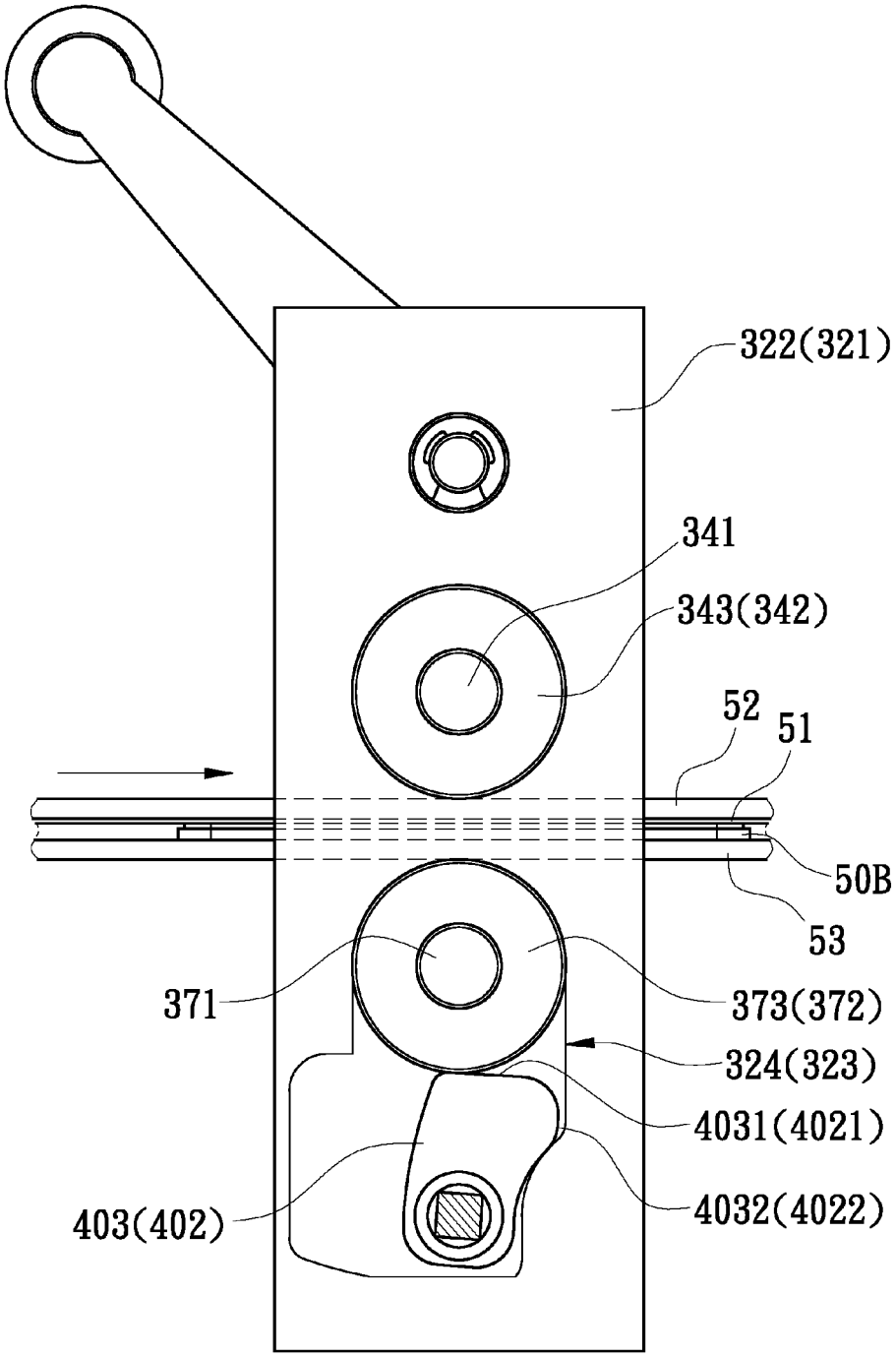
FIG. 10 is still another cross sectional view showing the operation of the stationery machine according to the first embodiment of the present invention.

As illustrated in FIGS. 9 and 10, when the machine body of the stationery machine is served to cut a second cutter template 50B with a small flat surface and thickness, the paper 51 is placed on the second cutter template 50B, and the upper clamp sheet 52 and the lower clamp sheet 53 are applied to press the second cutter template 50B and the paper 51, thereafter the second cutter template 50B and the paper 51 are inputted between the first pressing roller 34 and the second pressing roller 37. To match with the second cutter template 50B, the retainer 396 of the sleeve 394 is pressed so as to disengage the stop rim 3962 from the first recess 392, and the driven gear 38 and the sleeve 394 are pushed by the first spring 391 so that the driven gear 38 slides axially and corresponds to the second transmission gear 36, and the retainer 396 of the sleeve 394 retains in the second recess 393 by ways of the stop rim 3962, thus positioning the driven gear 38. Thereafter, the actuating slice 404 is rotated to drive the first cam face 4022 of the first biasing slice 402 and the second cam face 4032 of the second biasing slice 403, and then the first cam face 4022 and the second cam face 4032 push the two second bearing sets 372, 373 of the second pressing roller 37 so that the first top rim 4021 and the second top rim 4031 retain the two second bearing sets 372, 373, such that the driven gear 38 meshes with the second transmission gear 36, and a second distance between the first pressing roller 34 and the second pressing roller 37 is a rolling thickness for inputting the second cutter template 50B, thereafter the rotatable handle 333 is rotated so that the second transmission gear 36 drives the driven gear 38, and the first pressing roller 34 and the second pressing roller 37 roll the second cutter template 50B so as to cut the patterns on the paper.

Thereby, the distance between the first pressing roller 34 and the second pressing roller 37 allow to be adjusted to cooperate with the first cutter template 50A and the second cutter template 50B which have different thicknesses. In addition, the first cutter template 50A and the second cutter template 50B are applicable for the upper clamp sheet 52 and the same lower clamp sheet 53 in the same size.

Figure 11:
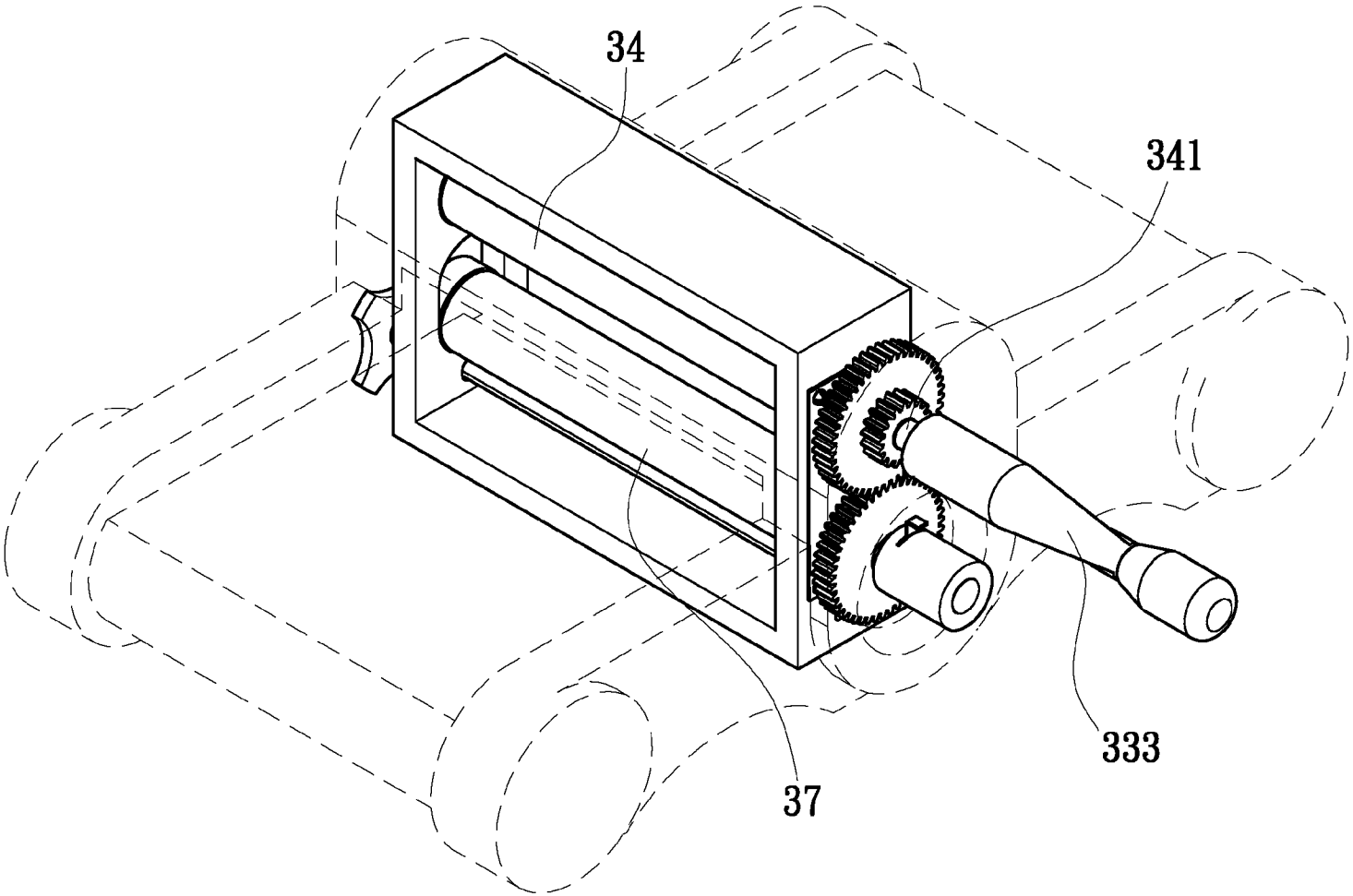
FIG. 11 is a perspective view showing the assembly of a stationery machine according to a second embodiment of the present invention.

Referring to FIG. 11, a difference of a stationery machine 30 of a second embodiment of the present invention from that of the first embodiment comprise: a rotatable handle 333 disposed on an outer side of the first rotary shaft 341 of the first pressing roller 34 so that the rotatable handle 333 is rotated to drive the first pressing roller 34 and the second pressing roller 37 simultaneously to cut the first transmission gear 35 and the second transmission gear 36, thus cutting the patterns on the paper.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A stationery machine being used to cut various patterns on a paper and comprising:

a housing for covering a machine body;

the machine body including a frame, the frame having a first side plate and a second side plate fixed on two sides thereof, and the first side plate and the second side plate having a first elongated slot and a second elongated slot defined on two lower sides thereof;

a first pressing roller having a first rotary shaft driven by a crank set and fixed between the first side plate and the second side plate, the first pressing roller also having at least two transmission gears in different sizes disposed on a first end of the first rotary shaft;

a second pressing roller having a second rotary shaft inserted in the first elongated slot of the first side plate and the second elongated slot of the second side plate, the second rotary shaft of the second pressing roller having a driven gear disposed on a first end thereof for moving axially;

an abutting mechanism biasing the second pressing roller to move upwardly and downwardly so as to adjust a distance between the second pressing roller and the first pressing roller, and the driven gear of the second pressing roller meshing with the at least two transmission gears of the first pressing roller.

2. The stationery machine as claimed in claim 1, wherein two ends of a first rotary shaft have two first bearing sets, and the two first bearing sets are connected with the first side plate and the second side plate.

3. The stationery machine as claimed in claim 1, wherein the at least two transmission gears of the first pressing roller is a first transmission gear and a second transmission gear, both of which are disposed on the first end of the first rotary shaft.

4. The stationery machine as claimed in claim 1, wherein the crank set has an input stem axially connected thereon, a driving gear fixed on a first end of the input stem for meshing with the first transmission gear, and a rotatable handle mounted on a second end of the input stem so that as rotating the rotatable handle, the driving gear is driven to actuate the first transmission gear.

5. The stationery machine as claimed in claim 1, wherein the crank set has a rotatable handle disposed on an outer side of the first rotary shaft of the first pressing roller so as to drive the first pressing roller.

6. The stationery machine as claimed in claim 1, wherein two ends of the second rotary shaft of the second pressing roller have two second bearing sets, and the two second bearing sets are placed in the first elongated slot of the first side plate and the second elongated slot of the second side plate.

7. The stationery machine as claimed in claim 1, wherein the adjusting mechanism has a first spring fitted on the second rotary shaft and a sleeve fitted onto the second rotary shaft, such that when the sleeve is pushed, the driven gear is driven by the sleeve to axially move along the second rotary shaft so as to correspond to the first transmission gear or the second transmission gear.

8. The stationery machine as claimed in claim 7, wherein the adjusting mechanism also has a first recess and a second recess defined at a predetermined position of the second rotary shaft, the sleeve has a retainer mounted therein and abutted by a second spring, the retainer has a through hole, a diameter of which is larger than the second rotary shaft, and the retainer also has a stop rim defined under the through hole so that when the driven gear corresponds to the first transmission gear or the second transmission gear, the retainer retains in the first recess or the second recess, thus positioning the driven gear.

9. The stationery machine as claimed in claim 1, wherein the abutting mechanism also includes a rotating rod axially connected with the first side plate and the second side plate, and the rotating rod has at least one biasing slice fixed on at least one end thereof to push the second pressing roller to move upwardly and downwardly.

10. The stationery machine as claimed in claim 9, wherein at least one biasing slice is a first biasing slice and a second biasing slice fixed on two ends of the rotating rod, and the first biasing slice has a first top rim and a first cam face, the second biasing slice has a second top rim and a second cam face, such that the first cam face and the second cam face push the second pressing roller to move upwardly and downwardly, and the first top rim and the second rim retain the second pressing roller.

* * * * *